United States Patent [19]

Gostelow

[11] Patent Number: 4,751,369

[45] Date of Patent: Jun. 14, 1988

[54] COOKING HOB WITH SPILLAGE TRAY

[75] Inventor: Benjamin F. Gostelow, Warrington, England

[73] Assignee: T. I. New World Limited, Arrington, England

[21] Appl. No.: 885,235

[22] Filed: Jul. 14, 1986

[30] Foreign Application Priority Data

Jul. 15, 1985 [GB] United Kingdom ..... 8517785

[51] Int. Cl.[4] ..... H05B 3/68

[52] U.S. Cl. ..... 219/451; 219/448; 219/459; 126/51; 126/39 BA

[58] Field of Search ..... 219/451, 443, 445, 446, 219/448, 452, 458, 459, 460, 461, 457, 463; 126/51, 39 BA

[56] References Cited

U.S. PATENT DOCUMENTS

| | | | |
|---|---|---|---|
| 2,305,165 | 12/1942 | Isbister | 219/460 |
| 2,325,358 | 7/1943 | Andrews | 219/463 |
| 2,867,711 | 1/1959 | Fisher | 219/458 |
| 3,004,132 | 10/1961 | Harris | 219/461 |
| 3,017,489 | 1/1962 | Andrews | 219/445 |
| 3,619,099 | 11/1971 | Moss et al. | 431/192 |
| 3,922,138 | 11/1975 | Biddle et al. | 431/193 |
| 4,490,603 | 12/1984 | Fischer | 219/459 |

FOREIGN PATENT DOCUMENTS

| | | | |
|---|---|---|---|
| 1301404 | 8/1969 | Fed. Rep. of Germany | 219/457 |
| 55-65833 | 5/1980 | Japan | 126/39 BA |
| 550747 | 11/1940 | United Kingdom | 219/452 |
| 808323 | 2/1959 | United Kingdom . | |
| 818793 | 8/1959 | United Kingdom | 219/451 |
| 885101 | 12/1961 | United Kingdom . | |
| 918324 | 2/1963 | United Kingdom . | |
| 1008770 | 11/1965 | United Kingdom . | |
| 1224218 | 3/1971 | United Kingdom . | |
| 1421196 | 1/1976 | United Kingdom . | |
| 2044440 | 10/1980 | United Kingdom . | |
| 2074714 | 11/1981 | United Kingdom . | |
| 2109603 | 6/1983 | United Kingdom | 126/39 BA |

*Primary Examiner*—E. A. Goldberg
*Assistant Examiner*—Teresa J. Walberg
*Attorney, Agent, or Firm*—Merchant, Gould, Smith, Edell, Welter & Schmidt

[57] ABSTRACT

A hob with a spillage tray (2), gas burners (16) and a member (30) secured to an undersurface of the spillage tray, gas taps (12) being accommodated between the member (3) and the spillage tray (2). The member (30) also forms, with the spillage tray (2), a respective fuel supply passage (33, 34, 35) for carrying fuel to each respective burner from the associated tap. The member (30) can be sealed, or sealed and secured, to the spillage tray by an adhesive. The hob may have electric heating units instead of, or in addition to, gas burners.

16 Claims, 7 Drawing Sheets

COOKING HOB WITH SPILLAGE TRAY

Figure 1:
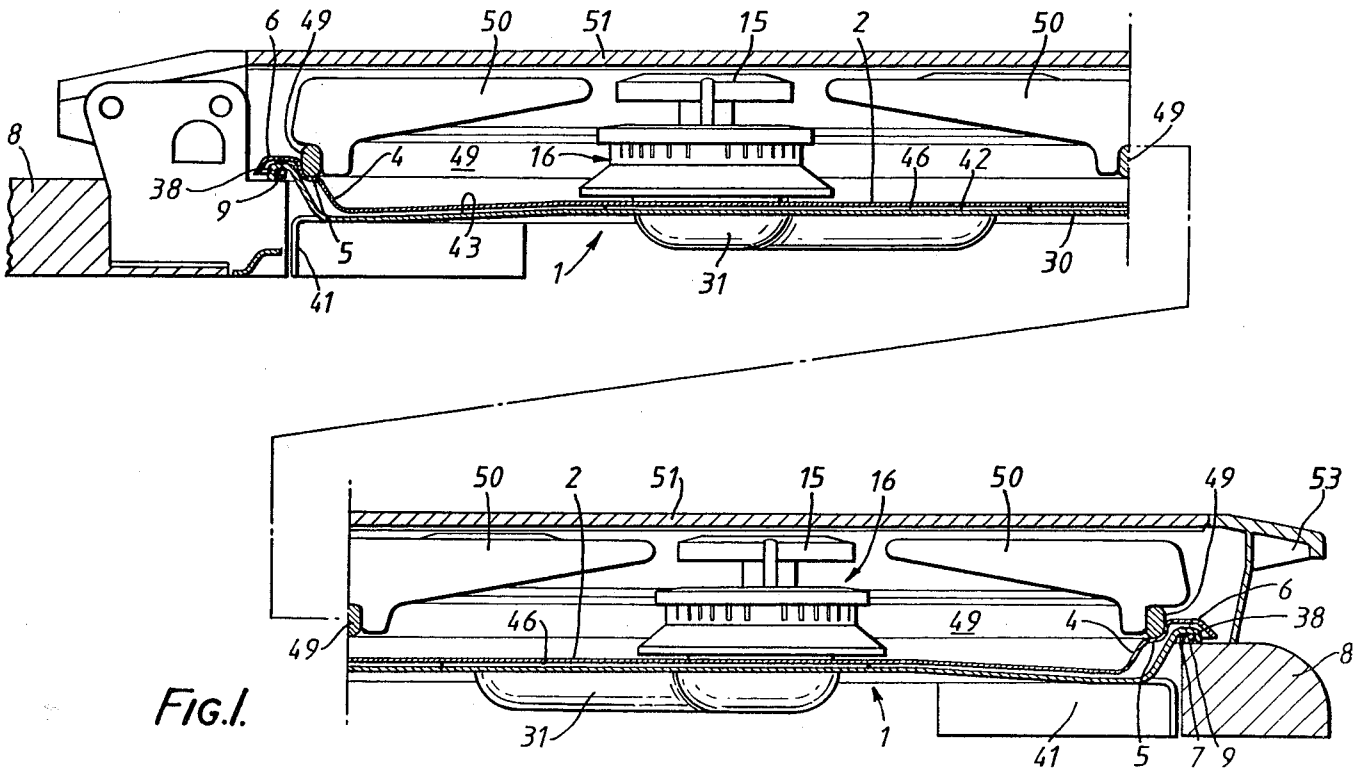

This invention relates to hobs and has particular reference to cooking hobs. The invention is also applicable to electric hobs and to hobs of the dual-fuelled kind, i.e. with both gas burners and electric rings and/or hot plates or other form of electric heating unit.

The hob may be an independent unit mounted in an aperture in the work surface of a kitchen unit or it may be part of a cooker. Such an independent unit is relatively deep in order to accommodate, in the case of a gas hob, gaseous fuel supply conduits that feed fuel to gas burners mounted on the upper surface of the spillage tray of the hob. Such a relatively deep unit has to be housed, at least in part, in the space beneath the work surface and this reduces the storage capacity of the unit.

According to the present invention, a hob comprises a spillage tray, one or more gas burners and/or electric heating units, one or more gas taps and/or one or more electrical switches for controlling the flow of gaseous fuel and/or electric energy to the or each gas burner and/or electric heating unit, the tap(s) and/or switch(es) being at least partly accommodated between the spillage tray and a member secured to the undersurface of the spillage tray.

The member may be of one-piece construction.

The member may have a recessed portion that accommodates at least partially the or each gas tap and/or the or each electric switch.

The present invention further provides a hob comprising a spillage tray, one or more gas burners, one or more gas taps for controlling the flow of gaseous fuel to the or each gas burner, and a member secured to the undersurface of the spillage tray to form therewith a respective fuel supply passages for each burner, the gas tap(s) being at least partly accommodated between the spillage tray and the member.

In this case, the hob may include a gas rail for supplying gaseous fuel to the or each burner, the rail and gas tap(s) being accommodated in a recessed portion of the member.

The recessed portion may be bounded in part by a wall with the or each supply passage terminating in that wall.

The member may be contoured to provide recesses which, together with the spillage tray, define the or each supply passage.

The or each supply passage may have a venturi-shaped portion and a portion for mixing gaseous fuel and entrained air.

The spillage tray may have a peripheral region contoured to provide, with the member, the or each venturi portion.

The spillage tray may have a central area raised relatively to the remainder of the spillage tray.

The peripheral region may be part of a peripheral margin round the central area.

Preferably, the or each gas burner and/or the or each electric heating unit is located in the central area.

The peripheral margin may slope downwardly from the central area.

The member may be contoured to conform closely with the configuration of the spillage tray and may be sealed to the undersurface of the latter by an adhesive.

The adhesive may also secure the member to the undersurface of the spillage tray.

The member may be contoured to define an area or areas to be scaled or sealed and secured to the undersurface of the spillage tray by the adhesive.

The area or areas may be adjacent the recesses.

If desired, the member may be secured or further secured to the spillage tray by other securing means for example mechanical securing means.

The mechanical securing means may comprise screws located at points adjacent the area or areas.

The adhesive may be a silicone-based adhesive or a toughened adhesive containing resilient particles.

The member, which can be a moulded component, may be made from a heat-resistant formable material.

The member may be made of a dementitious material for example a high strength organic material, based on hydraulic cement incorporating a small amount of an organic rheological aid.

The organic material may be such that not more than 2% of the total volume of the member comprises pores of maximum dimension exceeding 100 microns.

The organic material may include at least one water-soluble or water dispersing additive that is capable of aiding the processing of the material, and, at least one insoluble particulate material having an ultimate particle size of less than 0.1 micron.

The organic material may be one of those described in European Patent Applications Nos. 80.301909.0 and 81.301228.3.

Alternatively, the member may be made of a ceramic material or of a heat resistant toughened glass or of a heat resistant plastics material.

The spillage tray, which can be a moulded component, may be made from a heat-resistant formable material, for example a cementitious material or a ceramic material or a plastics material.

In cases where the hob includes at least one gas burner, ignition means for the or each burner may be provided, the electrical conductors interconnecting the ignition means and a control device therefore may be formed on the member or spillage tray or may be incorporated in the member or spillage tray.

Where the hob includes one or more electric heating units, the electrical conductors interconnecting the unit or units and respective electric control switches may be formed on the surface of the member or incorporated in the latter.

Again, where the hob includes one or more electric heating units, the member may include a pocket formed beneath the or each such unit.

The pocket may accommodate means for securing the heating unit in place and/or the terminal connectors of the unit.

Figure 2:
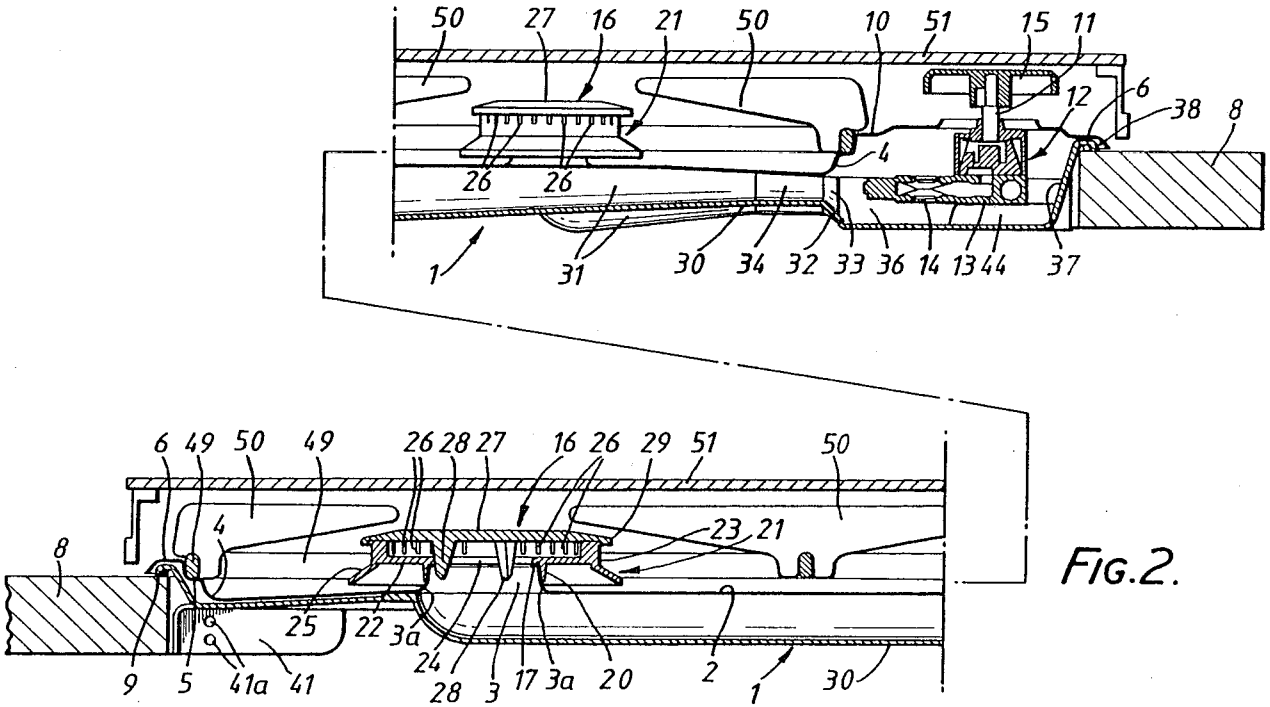
Figure 3:
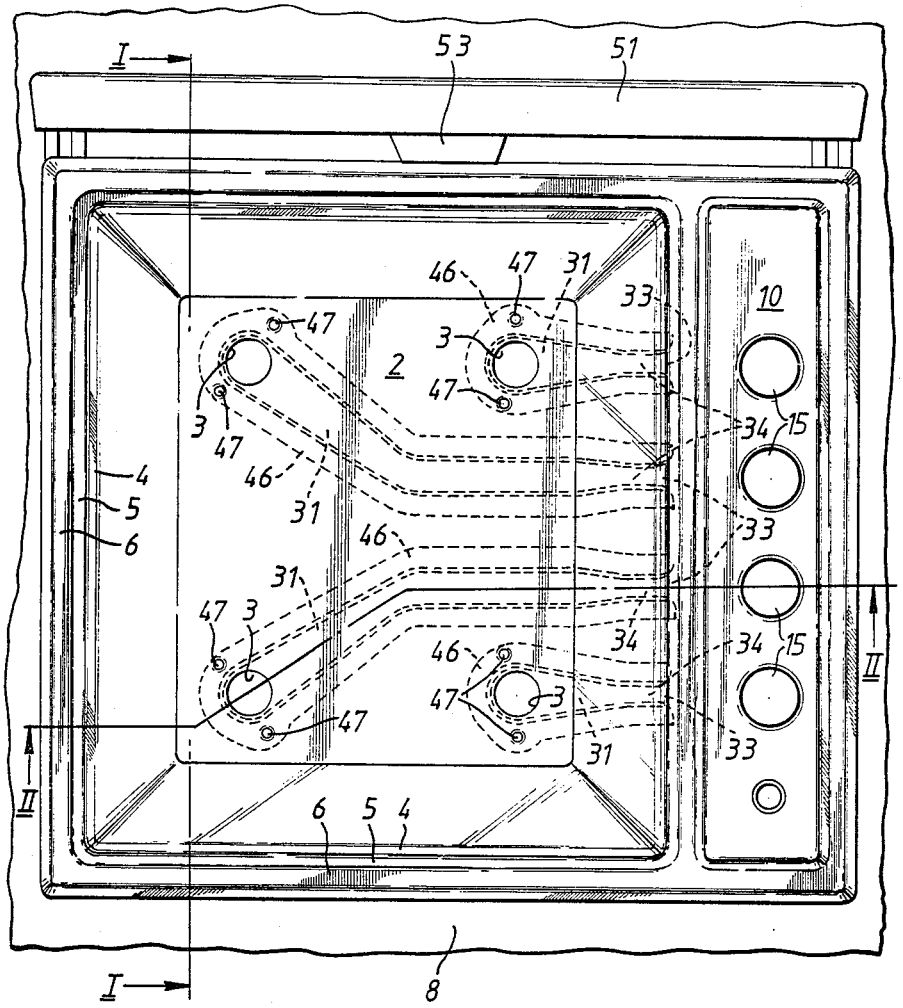
Figure 4:
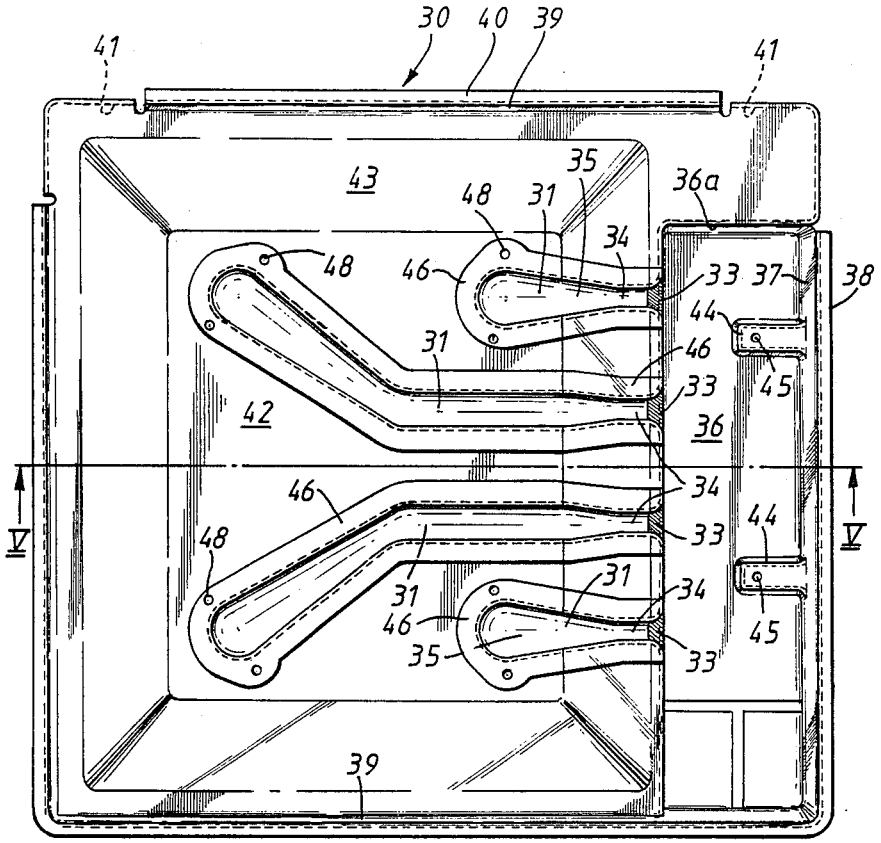
Figure 5:
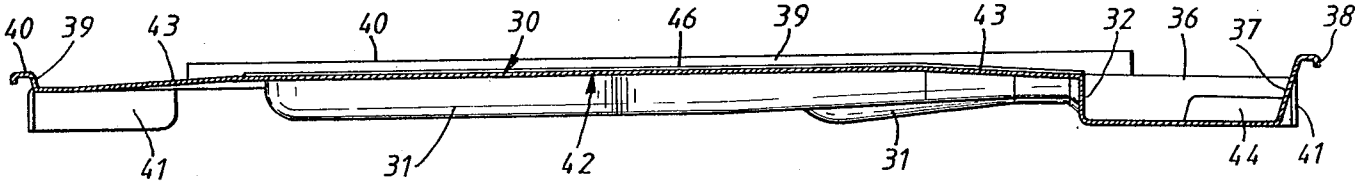
Figure 6:
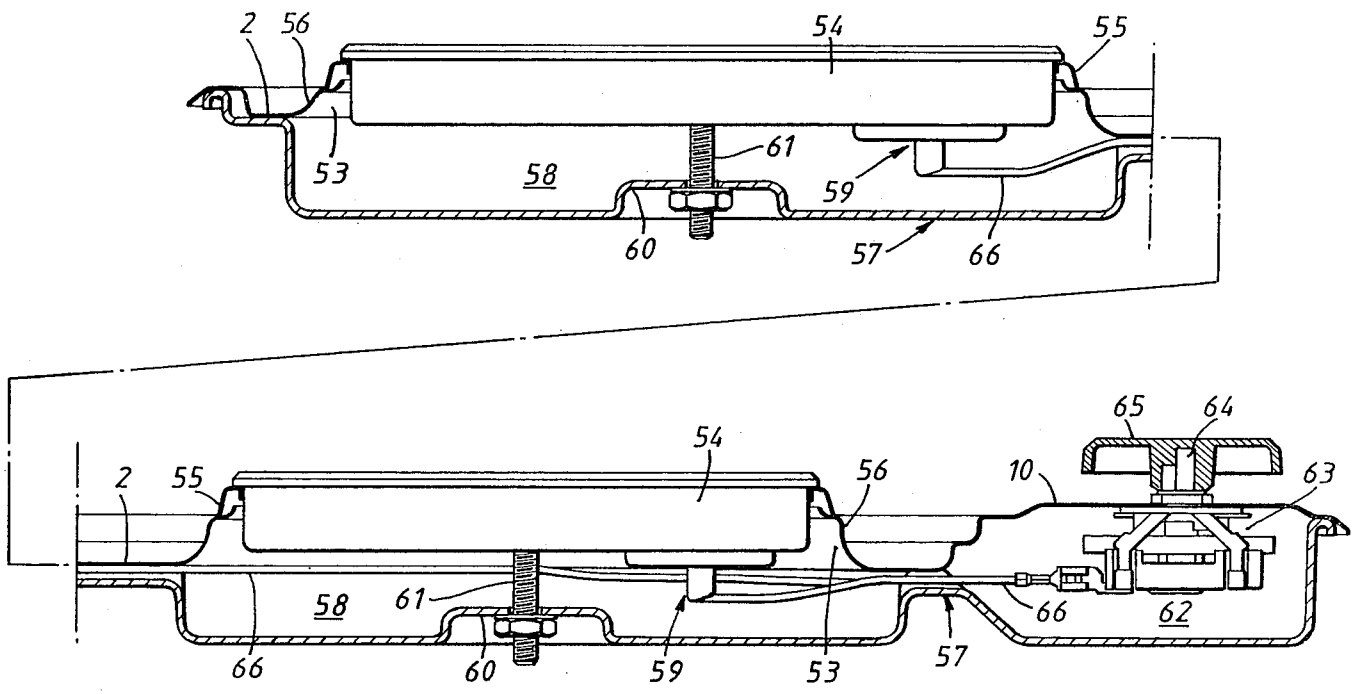
Figure 7:
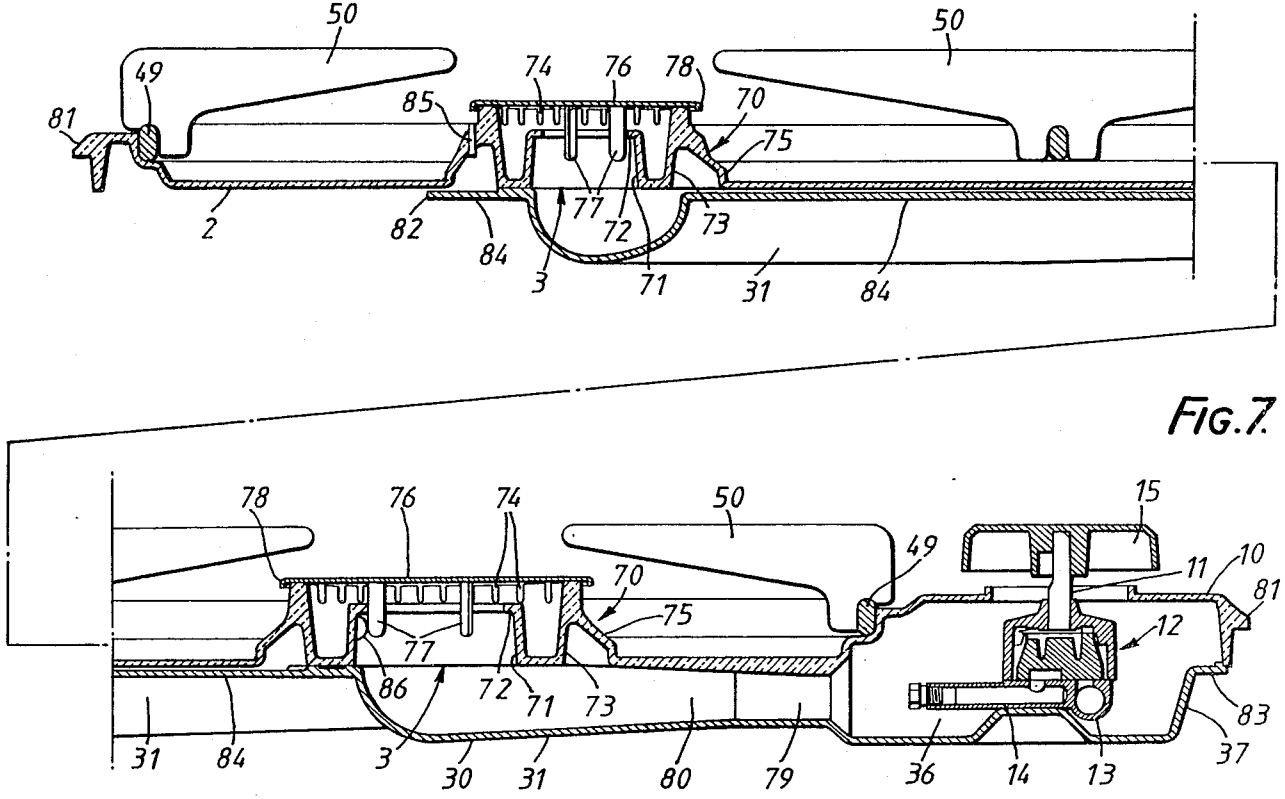

By way of example only, hobs embodying the invention will now be described in greater detail with reference to the accompanying drawings of which:

FIG. 1 is a front-to-back section on the line I—I of FIG. 3 but with the hob lid closed, FIG. 2 is a section on the line II—II of FIG. 3, FIG. 3 is a plan view of a hob with gas burners and with certain components removed, and mounted upon a work surface part only of which is shown, FIG. 4 is a plan view of a component of the hob of FIG. 3, FIG. 5 is a section on the line V—V of FIG. 4, FIG. 6 is a section corresponding with that of FIG. 1 of a hob with electric hot plates, and FIG. 7 is a section, similar to that of FIG. 2, of an alternative form of hob with gas burners.

The hob shown in FIGS. 1–5 comprises a shallow box structure 1 of generally rectangular form when seen in plan as in FIGS. 3 and 4.

The structure 1 comprises a rectangular spillage tray 2 that is apertured as at 3 and has, along three sides, an upwardly and outwardly sloping peripheral wall 4. The wall 4 is stepped as at 5 and its edge is contoured to form a downwardly-open channel 6. In, the drawings, the hob is shown as accommodated within a recess in a work surface 8. A sealing strip 9 forms a seal with the work surface 8 as will be described below. Along its fourth side the spillage tray is extended and contoured to form a control panel 10 raised slightly above the level of the work surface 8 as can be seen from FIG. 2. The outer edge of the panel 10 is formed to provide a continuation of the channel 6 along the fourth side of the spillage plate. The inner edge of the control panel 10 is formed to provide a continuation of the inclined, stepped wall 4. The panel 10 is apertured at spaced intervals to accommodate the upwardly-extending control spindles 11 of gas taps 12 that control the flow of gas through a gas rail 13 to injectors 14 extending from the rail. The spindless 11 carry control knobs 15 by which a user operates the gas taps. The gas rail is supported in a manner described below. The gas taps and the gas rail are described in more detail in U.K. Patent Application No. 84,24905 (Publication No. 2,165,337A), the contents of which are hereby incorporated.

The central area of the spillage tray 2 is raised slightly as can be seen from FIGS. 1 and 2, the apertures 3 being located in the raised areas. Round each aperture 3, the spillage tray is upset to provide a peripheral flange or locating boss 3*a* which locates and supports a gas burner head in a manner described in more detail below. Round the central area, the spillage tray has a downwardly sloping margin which ensures that any spillage thereon is directed towards the periphery of the spillage plate and away from the central area. The periphery of the spillage plate is cooler than the central raised area when the hob is in use so that by directing spillage away from the hotter central area, the risk of spillage "burning-on" to the surface of the spillage plate is reduced.

In addition, the contour of the sloping margin is chosen to provide, as will be described below, the upper surfaces of gas supply passages for the burners.

Finally, the particular contouring of the spillage plate controls the direction in which the plate may distort when heated and the knowledge of this enables the remainder of the hob structure to be designed to accommodate such distortion when it occurs.

Located centrally over the apertures 3 are gas burners 16 one of which is shown in section in FIG. 2. Each burner 16 seats on its locating boss 3*a*, the upper edge of the latter being inwardly turned as at 17 to provide an adequate seating surface. Engaged externally of and telescopically with the boss 3*a* is the boss 20 of a burner body member 21. The boss 20 projects downwardly from a horizontal partition 22 within the member 21. The partition 22 has a peripheral upstanding wall 23 and is apertured centrally as at 24 in alignment with the respective aperture 3. The wall 23 also extends downwardly beyond the partition 22 where it forms an outwardly inclined skirt 25 that conceals the telescopically engaged bosses 3*a* and 20. The wall 23 is slotted at intervals to form flame ports 26 and the upper edge of the wall supports a cap 27. As can be seen from FIG. 2, the cap 27 locates on the member 21 by means of three equi-spaced pins 28 that fit inside the aperture 24. The cap has a downwardly extending flange 29 that seats externally of the wall 23.

Secured to the underside of the spillage tray 2 is a member 30 whose superficial area is somewhat less than that of the spillage tray 6. The member 30 is shown in plan view in FIG. 4 and in section in FIG. 5.

The member 30 is contoured to mate with the spillage tray 6 and to provide four spaced depressions 31 that extend from a downwardly-inclined transverse wall 32. Each depression terminates adjacent a different one of the apertures 3. The depressions 31 are shaped to form with the spillage tray 2 gaseous fuel passages each with an entrance 33, a venturi tube 34 and a mixing chamber 35. Each of the entrances 33 is aligned with a different one of the injectors 14 and terminates at the transverse wall 32. The upper surfaces of the venturi portions 34 are provided by the marginal part of the spillage tray 2 as will be described below.

The member 30 is formed, along one side, with an elongate recess 36 bounded upon one side by the transverse wall 37 and on the other side by a wall 37. The wall 37 extends upwardly into the adjacent channel 6 and has a down-turned flange 38 that locates between the undersurface of the channel and the surface 8. The sealing strip 9 is located beneath the flange 38. Walls 39, generally similar to wall 37, are formed along the remaining sides of the member 30 except that the walls 39 are of a much reduced height as compared with the wall 37 to ensure that the flanges 40 on the wall 39 lie at the same level as flange 38.

As can be seen from FIG. 4, the walls 37 and 39 do not extend for the full length of the sides on two sides of the member 30 but stop short of each corner thereof. At each corner, the member 30 has downward extensions 41 that serve both to strengthen the member 30 in its corner areas and to locate the hob in the recess in the work surface as can be seen from FIGS. 1 and 2. On the other two sides, the walls 39 are continuous and extend around the corners.

The downward extensions 41 may be used to secure the hob in position and are provided with screw holes 41*a* for that purpose.

The member 30 has a central area 42 that is slightly raised and occupies an area corresponding with that of the raised area of the spillage tray 2. Surrounding the raised area 42 is a peripheral area 43 that slopes downwards slightly to conform closely with the peripheral area of the spillage tray 2 and to form with that area the entrances, and venturi portions of the gaseous fuel supply passages.

In an alternative form, the walls 37 and 39 extend for the full length of the associated sides instead of stopping short as explained above.

As can be seen from FIG. 4, the recess 36 does not extend for the full front-to-back dimension of the member 30 but stops short of the rear edge thereof as indicated at 36*a*. In that way, a pocket is formed beneath the member 30 to accommodate a gas inlet connection to the gas rail 13 within the confines of the hob. The floor of the recess has two spaced integral platforms 44 which support the gas rail 13 referred to above. The platforms 44 are apertured as at 45 to receive bolts by means of which the gas rail is secured in place.

As can be seen from the drawings, the recess accommodates both the gas rail 13 and the major part of each gas tap 12. Only the spindles 11 and the knobs 15 lie outside the recess. The taps 12 and the rail 13 are thus accommodated between the spillage tray 2 and the member 30, being concealed beneath the control panel 10 of the spillage tray 2.

The member 30 is sealed to the undersurface of the spillage tray 2 by means of a suitable adhesive dealt with in more detail below. Those parts of the member 30 immediately surrounding the depressions are formed to provide raised areas which define those areas of the plate to be sealed to the undersurface of the spillage tray 2. Those areas are indicated in FIG. 3 at 46 and are also shown in FIG. 4. The areas 46 lie between the respective depressions 31 and the remainder of the member. The adhesive may also secure the member 30 to the undersurface of the spillage tray 2 in addition to sealing the separate gaseous fuel passages and preventing leakage of gaseous fuel therefrom.

The attachment of the member 30 to the spillage tray 2 is consolidated by mechanical means, for example nuts and bolts indicated schematically at 47 in FIG. 3, the member 30 being suitably apertured as indicated at 48—FIG. 4. As can be seen from FIG. 3, the nuts and bolts are located at the positions well clear of the gaseous fuel passageways.

Alternatively, however, the adhesive may be used both to seal and to spoure the member 30 to the undersurface of the spillage tray. For additional security mechanical attachment may be used as well.

Resting on the stepped parts 5 of the walls 4 of the spillage tray 2 is a frame 49 carrying pan supports 50 located, in conventional manner, round each burner 16.

When not in use, the hob is covered by a lid 51 pivotally mounted between brackets 52 attached to the downward extension 41 of the member 30. The front edge of the lid has a handle 53 by which a user can swing the lid from the closed position shown in FIG. 1 to an open position shown in FIG. 3 and in which the lid is in a vertical position at the rear of the hob so giving complete access to the burners and controls. Preferably, the weight of the lid is counterbalanced by, for example, the mechanism described in co-pending Patent Application No. 84.24904 (Publication No. 2,165,350A).

FIG. 6 shows, in cross section similar to that of FIG. 2, an alternative embodiment of the invention suitable for use as an electric hob.

The general construction of the hob shown in FIG. 6 is similar to that of the gas hob described above. The hob has a spillage tray 2 that has four spaced circular holes 53 (only two of which are shown in FIG. 6) each of which accommodates a solid electric heating plate 54 of conventional form. Supports 55 round the plates prevent any spillage leaking into the holes 53. The supports 55 bridge and thereby seal the gaps between the peripheries of the plates 54 and upturned flanges 56 round the holes 53 as well as supporting the plates 54 on the respective flanges 56.

To the undersurface of the spillage tray 2 is secured a member 57 generally similar to member 30 described above but having pockets 58 positioned to locate beneath the plates 54 for accommodating the terminal connections 59 of the plates. Each pocket 58 has a central boss 60 through which extends a bolt 61 by which the plate 54 located above the pocket is secured in place.

Along one side, the spillage tray 2 is formed with a control panel 10 similar to that described above. That part of the member 57 beneath the panel 10 has a longitudinal depression 62 to provide accommodation for control switches by which a user controls and regulates the supply of electricity to the plates 54. One of such switches is shown in FIG. 6 at 63. Each switch has a control spindle 64 that extends upwardly through the spillage tray 2 and has a control knob 65 mounted upon its outer end. Electric leads extend from the switches to the respective hot plates and, like the control switches 63, are accommodated between the spillage plate 2 and the member 57. Some of the leads are shown in FIG. 6 at 66.

As can be seen from FIG. 6, the member 57 has parts of its surface that lie closely adjacent the undersurface of the spillage tray 2. Such areas or some of them are sealed or sealed and secured to the adjacent spillage tray surface by a suitable adhesive dealt with in more detail below. If the adhesive is used merely as a sealant, attachment of the member 57 to the spillage tray 2 may be by mechanical means, for example by nuts and bolts, in the manner described above. Where the adhesive is used both to seal and secure, mechanical attachment may also be utilised.

Preferably, where the leads 66 cross areas that are sealed to the undersurface of the spillage tray 2, the areas are channelled to receive the leads and allow the latter to be withdrawn if necessary without the need to "break" sealing.

The construction of the hob shown in FIG. 6 is otherwise similar to that of the gas hob described above.

It will be appreciated that the solid hot plates 54 may be replaced by electric rings also of conventional construction employing electric resistance heaters or by electrically-energised infra-red heating units, or a combination of such alternatives may be used.

The spillage trays 2 of the hobs described above are made of vitreous enamelled sheet metal. It is, however, also possible for the spillage tray of a hob to be made of a non-metallic heat-resistant material and a hob having such a spillage tray is shown in FIG. 7. The hob is generally similar to that shown in FIGS. 1 to 5 and corresponding components carry similar reference numerals.

The spillage tray 2 of FIG. 7 is a moulded component formed from a cementitious composition but it could be any suitable heat-resistant formable material, for example a ceramic or a plastics material. The upper surface at least of the tray can be treated or coated, if necessary, to provide the required finish.

The spillage tray 2 of FIG. 7 differs from the sheet metal tray of FIG. 2 in that, around each burner aperture 3, it is formed to provide an integral burner structure 70 comparable to the combination of the boss 3*a* and burner body member 21 of FIG. 2. Each burner structure 70 comprises an upstanding boss 71 around the burner aperture 3, the upper edge of the boss being inwardly-turned as indicated at 72. Extending upwardly from the base of the boss portion 71 and around the outside of the latter is a wall 73. The wall 73 is higher than the boss 71 and is slotted at intervals around its upper edge to form flame ports 74. Extending outwardly and downwardly from the wall 73 is a skirt 75 the lower edge of which merges with the generally-horizontal part of the spillage tray. A burner cap 76 is supported on the upper edge of the wall 73. The burner cap 76 is a pressed-metal component and has downwardly-extending pins 77 which fit inside, and locate against, the inwardly-turned edge of the boss 71. At its periphery, the burner cap 76 has a downwardly-extending flange 78 which is located on the outside of the upstanding wall 73.

The burner body structure 70 is thus formed as an integral part of the spillage tray and only the burner cap 76 is a separate component. The spillage tray 2 differs further from that shown in FIG. 2 in that the thickness of the tray 2 is increased slightly in the region of each of the venturi portions 79 of the fuel supply passages 80 which lead to the burner apertures 3. This increase in thickness enables the required shaping of the venturi portions 79 to be achieved without a corresponding shaping of the upper surface of the spillage tray 2.

At its periphery, the spillage tray 2 has an outwardly-extending flange 81 which rests on the work surface (not shown) in which the hob is installed. The spillage tray 2 of FIG. 7, like that of FIG. 2, has a member 30 secured to its undersurface to form the fuel supply passages 80 and also the recess 36 which accommodates the gas rail 13 and the major part of each gas tap 12 whereby the taps and gas rail are accommodated between the member 30 and the spillage tray. The member 30 of FIG. 7 is less extensive than that of FIG. 2 and terminates, at 82, adjacent the burners remote from the control panel 10. On the opposite side of the member 30, the wall 37 bounding the recess 36 has an outwardly-extending flange 83 on which the edge of the spillage tray 2 rests, this flange being below the level of the work surface.

The member 30 of FIG. 7 can be sealed and secured to the tray 2 by an adhesive supplemented, if required, by mechanical means for example nuts and bolts. To this end, the member 30 (like that of FIG. 2) is formed with areas which lie closely adjacent the undersurface of the spillage tray 2, such areas being indicated at 84. These areas 84 are located immediately around the depressions 31 formed in the member 30 to define the fuel supply passages 80.

The lower members 30 and 57 of the embodiments may be made from any suitable heat-resistant formable material. They may, for example, be moulded from a high strength organic material, based on a hydraulic cement with a small amount of a rheological aid. The material and its production are described in more detail in European Patent Applications Nos. 80.301909.0 (0 021 682) and 81.301228.3 (0 036 126). Alternatively, a suitable ceramic material or temperature resistant plastics material may be used. For example, a ceramic structure may be made by mixing a ceramic powder with water to form a plastic mass which is then moulded and fired.

The members 30 and 57 may also be of heat-resisting toughened glass.

The adhesive used to secure and seal the lower member 30 or 57 to the spillage tray 2 is a silicone based adhesive and provides a slightly flexible bond between the spillage tray and the plate. Such an adhesive will accommodate slight movement of the spillage tray relatively to the plate which may result from temperature gradients between the tray and the plate.

Alternatively, other adhesives may be used, including toughened adhesives which are epoxy resin and acrylic adhesives to which resilient particles, for example rubber particles, have been added to stop the promulgation of cracks through the adhesive once it has been set or cured can be used instead.

The reliability of the adhesive used to secure the lower member 30 or 57 to the spillage tray 2 is, to some extent, assisted by the lower working temperatures which can result from the construction of the hobs described above. In the hob of FIGS. 1 to 5, for example, heat transfer from the burners 16 to the spillage tray is limited by the formation of the boss **3*a* while further cooling of the spillage tray results from the flow of gaseous fuel along the gaseous fuel passageways of which the spillage tray itself forms one wall. Such cooling also occurs in the hob of FIG. 7** and is maximised by ensuring maximum intake of primary air. In both of these embodiments, the burner heads and flame ports are designed to produce flames that have a flat attitude and this tends to encourage a greater flow of secondary air which, as it flows over the spillage tray, helps to keep the latter cool.

In the embodiments of FIGS. 1 to 5 and 7, the lower member 30 may, as already described, be made of a material that is an electrical insulant. In this case, it can carry open, ie non-insulated, suitably-spaced electrical conductors which connect with electrical ignitors that may be provided to ignite gaseous fuel issuing from the burners. In FIG. 7, an ignition electrode from one of the burners is indicated at 85 while, for another of the burners, an earth clip is indicated at 86. It will be understood that each burner is provided with a similar ignition electrode and associated earth clip, the electrode being positioned, as shown, in the outwardly-extending skirt 75 of the burner structure and the earth clip being located inside the boss 71. A suitable control knob for such ignitors may be provided on the control panel 10. The conductors may be applied to the surface of the member 30 by known techniques for example those used in the fabrication of printed circuits or incorporated into the member during the fabrication thereof. As an alternative, in the embodiment of FIG. 7 (in which the spillage tray is made of a material which is an electrical insulator), the conductors could be applied to, or incorporated in, the spillage tray 2. Alternatively, in both embodiments, conventional electrical leads can be used, these leads being located between the lower member 30 and the spillage tray.

The lower member 30 may also be used to accommodate other electrical controls, leads and components.

In the embodiment of FIG. 6, the lower member 57 may also (as already described) be made of a material which is an electric insulator. In that case, it is possible to replace the leads 66 by conductors printed or otherwise applied to the surface of the member, care being taken to ensure adequate spacing of such conductors from the spillage tray 2. Alternatively, the conductors may be incorporated into the lower member 57 during the fabrication thereof.

The sandwich construction provided by the spillage tray 2 and lower member 30, 57 described above ensures a rigid assembly and one that can be put together by automatic machinery.

Although a one-piece lower member 30 has been used in the gas hobs shown in FIGS. 1 to 5 and 7, this is not essential. Several plates may be used each having at least one depression to form the fuel supply passages with the spillage tray 2.

In addition, although the embodiments described above are all built-in hob units, the invention can be incorporated corporated in a free-standing cooker, gas and/or electric, with such modifications as may be necessary to adapt the hob construction for inclusion in the cooker.

I claim:

1. A hob comprising: a spillage tray which forms an upper surface of the hob; one or more heating units; one or more control devices for controlling a supply of fuel/energy to the one or more heating units; and a lower member which is contoured to mate with the spillage tray and which extends beneath the spillage tray in close proximity thereto, the lower member being secured within its periphery to an undersurface of the spillage tray, the spillage tray and/or the lower member being contoured to provide a recess therebetween to at least partly accomodate said one or more control devices.

2. A hob as claimed in claim 1 in which the lower member is contoured to provide therein a recessed portion that accommodates part at least of the one or more control devices.

3. A hob as claimed in claim 1, in which the lower member is made from a heat-resistant formable material.

4. A hob as claimed in claim 3, in which the lower member is made of a cementitious material or of a ceramic material or of a toughened glass or of plastics material.

5. A hob as claimed in claim 1, in which the spillage tray is made from a heat-resistant formable material.

6. A hob as claimed in claim 5, in which the spillage tray is made of a cementitious material or of a ceramic material or of a plastics material.

7. A hob as claimed in claim 1, comprising said one or more heating units being electric heating units, and in which electrical conductors interconnect the one or more units and the one or more control devices.

8. A hob comprising: a spillage tray which forms an upper surfaces of the hob, one or more gas burners, one or more gas taps for controlling a flow of gaseous fuel to the one or more gas burners, and a lower member which is contoured to mate with the spillage tray and which extends beneath the spillage tray in close proximity thereto, the lower member being secured within its periphery to an undersurface of the spillage tray to form therewith a respective fuel supply passage for each burner, the spillage tray and/or the lower member being contoured to provide a recess therebetween to at least partly accomodate said one or more gas taps.

9. A hob as claimed in claim 8 including a gas rail for supplying gaseous fuel to each respective supply passage, and in which the gas rail and the said one or more gas taps are accommodated in a recessed portion of the lower member.

10. A hob as claimed in claim 9, in which the recessed portion is bounded in part by a wall, each respective supply passage terminating in that wall.

11. A hob as claimed in claim 9, in which the spillage tray is made from a heat-resistant formable material and in which each of the one or more gas burners has a body which is an integral part of the spillage tray.

12. A hob as claimed in claim 8, in which the lower member is contoured to provide recesses which, together with the spillage tray, define the respective supply passage(s).

13. A hob as claimed in claim 8, in which the lower member is sealed to the undersurface of the spillage tray by means of an adhesive.

14. A hob as claimed in claim 13, in which the adhesive also secures the lower member to the undersurface of the spillage tray.

15. A hob as claimed in claim 13, in which the lower member is contoured to define an area or areas to be sealed to the undersurface of the spillage tray by the adhesive.

16. A hob as claimed in claim 8 and comprising electrically energisable ignition means for the one or more burners, and control means for controlling the energisation of the ignition means, and in which electrical conductors interconnecting the ignition means and the control means are formed on the lower member or spillage tray or are incorporated in the lower member or spillage tray.

* * * * *